United States Patent [19]

Jones

[11] 4,185,434

[45] Jan. 29, 1980

[54] BUILDING BLOCK

[75] Inventor: Glyndwr M. Jones, Christchurch, New Zealand

[73] Assignee: Winstone Limited, Auckland, New Zealand

[21] Appl. No.: 873,866

[22] Filed: Jan. 31, 1978

[30] Foreign Application Priority Data

Feb. 3, 1977 [NZ] New Zealand ..... 183252

[51] Int. Cl.[2] ..... E04C 2/29; E04C 1/40

[52] U.S. Cl. ..... 52/405; 52/570; 52/612

[58] Field of Search ..... 52/405, 309.12, 574, 52/569, 308, 437, 570, 571, 612, 396, 403, 612, 572

[56] References Cited

U.S. PATENT DOCUMENTS

| | | | |
|---|---|---|---|
| 769,120 | 8/1904 | Tisch | 52/569 |
| 825,107 | 7/1906 | Brandell | 52/606 |
| 2,073,673 | 3/1937 | Blake | 52/569 |
| 2,172,052 | 9/1939 | Robbins | 52/606 |
| 3,382,302 | 5/1968 | Marzocchi | 428/308 |
| 3,817,013 | 6/1974 | Selby | 52/570 |
| 3,828,504 | 8/1974 | Egerborg | 52/396 |
| 3,984,957 | 10/1976 | Piazza | 52/405 |

*Primary Examiner*—John E. Murtagh

*Attorney, Agent, or Firm*—Watson, Cole, Grindle & Watson

[57] ABSTRACT

A building block comprising a pair of plane walls which constitute a front and rear wall thereof, the front and rear walls being formed without connecting bridges or webs therebetween and being maintained in spaced relationship by an insulating material. In one embodiment the block is formed from two block parts, the first block part including the front wall of the block and the second block part including the rear wall of the block, the arrangement of the block parts being such that the parts are maintained spaced apart by a layer of insulating material and the shape of the block parts being such that a portion of one block part projects within the confines of the other block part.

2 Claims, 1 Drawing Figure

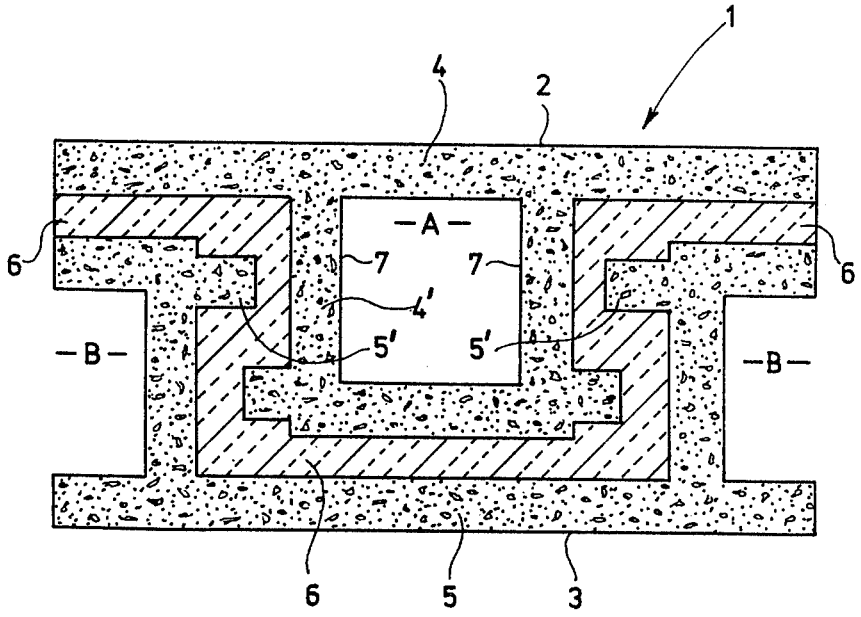
1
4
2
6
6
7
7
4'
5'
5'
—A—
—B—
—B—
6
5
3

BUILDING BLOCK

FIELD OF THE INVENTION

The invention relates to building blocks and more particularly relates to a building block having improved and advantageous insulating properties.

DESCRIPTION OF THE PRIOR ART

In the prior art there exists a number of different constructions of building block having improved insulating properties and such building blocks have been constructed and designed so as to reduce the heat loss across the block by providing between the front and rear faces or walls of the block either insulating cavities or layers of insulation.

An example of such a construction of building block is described in New Zealand Pat. No. 136883 which discloses a building block and describes the use therein of a sheet of insulating foil extending across cavities within the block. The insulating material inhibiting the passage of heat across the cavities however, this construction of block includes webs or bridges across the ends and/or the middle thereof between the cavities and it has been found that an unacceptable amount of heat is lost through these webs thus reducing the overall insulating effectiveness of a wall constructed from blocks of this type.

In a further attempt to overcome this disadvantage a further block was designed and is the subject of New Zealand Pat. No. 169811 which describes a standard cavity building block having an additional elongate cavity extending from the top to the bottom thereof substantially parallel to the front or rear face of the block. In this construction a sheet of heat reflective material or a layer of insulating material is arranged within the additional cavity so as to impede the transfer or loss of heat across the block between the front and rear walls thereof.

This construction suffers from the same disadvantage as the block the subject of New Zealand Pat. No. 136883 in that the elongate cavity has at either end thereof webs through which heat loss occurs and also there is a tendency for the long narrow wall or face of the block adjacent to the additional cavity to break during harsh treatment which is sometimes afforded the block by a blocklayer during the laying of such blocks.

Another known construction of concrete blocks has utilised two planar outer block faces between which is positioned a block or mass of insulating material. Such a block construction is described in New Zealand Pat. Nos. 169054/169088 and 172762. These constructions of block however have a serious disadvantage in that there is no provision made therein for reinforcing materials to pass therethrough.

The other disadvantage of such a block construction is that the two parts of the block have to be joined by joining members being plastics or wire joiners described in New Zealand Pat. Nos. 169054/169088 and 172762.

Accordingly it is a general object of the present invention to overcome at least in part the disadvantages inherent in known building blocks and to provide a building block without connecting bridges between the front and rear walls thereof so as to reduce and inhibit the transfer or loss of heat between the front and rear walls of the block and so improve the insulating properties of the building block.

Other objects and advantages of the present invention which should be considered in all its novel aspects will become apparent from the following description which is given by way of example only.

SUMMARY OF THE INVENTION

According to a first aspect of the present invention there is provided a building block having a pair of plane walls which constitute a front and rear wall thereof, the front and rear walls being formed without connecting bridges therebetween and being maintained in spaced relationship by an insulating material.

The building block can be constructed of any suitable material, for example, any cementitious material, baked clay or other similar materials and can include a cavity or cavities as required by normal building practises. The cavities can be formed in the building block so that when a structure is formed therefrom the cavities can be overlapped to provide for vertical or horizontal cavities which can be reinforced or strengthened as required.

The insulating material which maintains the front and rear walls of the building block in a spaced relationship can be any suitable insulating material, for example, urea formaldehyde, polystyrene or polyurethane foam or other similar insulating materials which can include as strengthening material therein a glass reinforced plastics material and preferably the insulating material is a foam forming resin.

According to a second aspect of the present invention there is provided a building block having a pair of plane walls which constitute front and rear walls thereof, the front and rear walls being maintained in spaced relationship by a layer of insulating material and being formed without connecting bridges therebetween by forming two block parts which when placed together are maintained in spaced relationship by the layer of insulating material, the first block part including the front wall of the block and the second block part including the rear wall of the block, the arrangement of the two block parts being such that a portion of one block part projects within the confines of the other block part.

Other aspects of the present invention which should be considered in all its novel aspects will become apparent from the following description which is given by way of example only of the present invention.

BRIEF DESCRIPTION OF THE DRAWINGS

The above-mentioned and other features of the present invention will become apparent by reference to the following specification described in conjunction with the accompanying drawing in which:

The single drawing FIGURE is a plan view of a building block in accordance with the present invention.

DESCRIPTION OF THE PREFERRED EMBODIMENT

The building blocks according to the present invention can be constructed of any suitable material, for example, any cementitious material, baked clay or other material and the blocks can include cavities therein which are dimensioned to suit known building requirements. It is also envisaged that half blocks, end blocks and bond beam blocks according to the present invention can be constructed in accordance with the invention described but have not been described herein.

The example of building block shown in the drawing is generally designated 1 and has two parallel faces or walls, each having at least one plane or outer face. One of the two parallel walls constitutes a first wall 2 and the other constitutes a second wall 3. It is envisaged that either of the first or second walls 2, 3 respectively can constitute the front or rear wall of the block as required. In a wall constructed of a plurality of the blocks 1 according to the invention in any one layer of blocks the same wall constitutes the front or rear wall of the construction and on successive layers of building blocks the blocks 1 are reversed so that the cavities therein are aligned vertically for receiving vertical reinforcing therein should this be required.

The first and second walls 2 and 3 of the block 1 are formed on separate block parts 4 and 5 having internal sections 4' and 5', respectively. The internal sections 4' and 5' are shaped to enable a portion of one block part 4 to project within the confines of the other block part 5 as shown with a layer of insulating material 6 therebetween. The layer of insulating material 6 can be of a constant thickness and maintains the two block parts 4 and 5 in spaced relationship with the first and second walls 2, 3 thereof substantially parallel.

The insulating material 6 can, for example, be urea or phenol formaldehyde, polystyrene, phenolic resins or polyurethane foam or can be a foam forming resin with or without glass reinforced plastics reinforcing therein for strength. The insulating material 6 when inserted into the space between adjacent block parts 4 and 5 maintains the first and second walls 2 and 3 in spaced relationship at the same time as forming a bond which maintains the complete block 1 as a unit.

The example of block 1 shown in the drawing has a cavity A formed within the internal section 4' of the block part 4 and dimensioned to suit the particular requirements of the block 1. This cavity A is formed between bridge portions 7 of the block part 4, which are connected to the first wall 2 of the block 1 and extend toward the other wall 3 of the block 1.

The cavities B are formed in either end of block part 5 and form part of the sides of the internal section 5' on the second wall 3 of the block 1. The cavities B are substantially half the size of the cavity A so that when a plurality of blocks 1 are placed in juxtaposition with each other to form a wall construction with mortar therebetween the overall dimensions of adjacent cavities B are substantially the same as the overall dimensions of the cavity A.

Preferably the cavities A and B are tapered so that at the base or bottom of the block 1 the overall dimensions of the cavities are smaller than the overall dimensions of the cavities at the top of the block 1.

It is envisaged that in order to reduce the overall weight of blocks formed in accordance with the invention the dimensions of the parts from which the block is formed are maintained at the minimum allowable by appropiate standards and advantageously the blocks are constructed from a cementitious material including a pumice or perlite sand so as to reduce the overall weight thereof.

Building blocks in accordance with the present invention can be utilised in conjunction with similar building blocks including half blocks, end blocks and bond beam blocks as required to form a wall of any suitable construction so as to have the advantage of a high resistance to the transfer of heat between the front and rear walls of the blocks.

Thus by this invention there is provided a building block without connecting bridges between front and rear walls of the block so as to reduce the heat transfer between the front and rear walls and so improve the insulating properties of the block.

A particular form of the invention has been described by way of example and it is envisaged that modifications to and variations of the invention can take place without departing from the scope of the appended claims.

What I do claim and desire to obtain by Letters Patent of the United States is:

1. A wall construction of a plurality of building blocks each having opposing plane walls and opposing ends, each said block comprising first and second block parts respectively including said walls, one of said block parts of said each block having a portion projecting toward an inner surface of the other of said block parts of said each block, said portion lying centrally between said opposing ends and being of a first predetermined size and shape, said other block part of said each block having sections at said opposing ends extending toward an inner surface of said one block part of said each block, said sections being of a size and shape each equal to one-half said first size and shape, said block parts of said each block being entirely spaced apart between said opposing ends so as to define a continuous gap between said block parts, said gap of said each block being completely filled by a quantity of insulating material disposed therein, whereby said walls of said each block are completely insulated from one another by said insulating material extending continuously between said opposing ends, said plurality of blocks forming courses overlying each other to form the wall construction, said blocks of alternate ones of said courses being aligned therebetween, and said blocks of remaining ones of said courses being aligned therebetween but displaced relative to said alternate courses a distance equal to one-half that between said opposing ends, and one of said plane walls of said alternate courses and the other of said plane walls of said remaining courses lying in a common plane, whereby said opposing plane walls of the wall construction are continuously separated by said insulating material as said portions of one of said courses align with said sections of the other of said courses.

2. The wall construction according to claim 1, wherein said portion of said each block has a cavity therein of a second predetermined size and shape, and said sections of said each block have end cavities therein of a size and shape each equal to one-half said second size and shape.

* * * * *